US007032987B2

(12) United States Patent
Bhattacharjya et al.

(10) Patent No.: US 7,032,987 B2
(45) Date of Patent: Apr. 25, 2006

(54) NOZZLE SCHEDULING FOR INK JET PRINTING

(75) Inventors: Anoop K. Bhattacharjya, Campbell, CA (US); Joseph Shu, San Jose, CA (US)

(73) Assignee: Seiko Epson Corporation, Tokyo (JP)

( * ) Notice: Subject to any disclaimer, the term of this patent is extended or adjusted under 35 U.S.C. 154(b) by 217 days.

(21) Appl. No.: 10/788,512

(22) Filed: Feb. 27, 2004

(65) Prior Publication Data

US 2005/0190233 A1 Sep. 1, 2005

(51) Int. Cl.
*B41J 29/38* (2006.01)

(52) U.S. Cl. ..... 347/12; 347/9; 347/13; 347/47

(58) Field of Classification Search ..... 347/12
See application file for complete search history.

(56) References Cited

U.S. PATENT DOCUMENTS

| | | | | |
|---|---|---|---|---|
| 6,302,505 | B1 * | 10/2001 | Askeland et al. | 347/9 |
| 6,457,806 | B1 | 10/2002 | Hickman | |
| 6,478,396 | B1 * | 11/2002 | Schloeman et al. | 347/12 |
| 6,575,548 | B1 | 6/2003 | Corrigan, III et al. | |
| 2003/0081233 | A1 | 5/2003 | Obrador | |

* cited by examiner

*Primary Examiner*—David Gray
*Assistant Examiner*—Brian J. Goldberg
(74) *Attorney, Agent, or Firm*—Michael T. Gabrik

(57) ABSTRACT

Nozzle scheduling algorithms that provide a unified approach to designing nozzle firing algorithms that incorporate a variety of specifiable nozzle-firing constraints such as print head (nozzle) geometry, nozzle spacing, number of nozzles, head movement (number of passes), ink-media interaction, etc. Such constraints are provided as design rules for a given printer/output medium, and the result is an appropriate nozzle firing algorithm. The design algorithms may be used to generate nozzle firing sequences in a halftone-dependent or halftone-independent manner.

21 Claims, 3 Drawing Sheets

NOZZLE SCHEDULING FOR INK JET PRINTING

BACKGROUND OF THE INVENTION

1. Field of the Invention

The present invention relates to design algorithms that are able to take into account a wide variety of nozzle-firing constraints in designing nozzle scheduling/firing algorithms that are specific for certain conditions. The algorithms may be realized as methods, incorporated into an appropriate apparatus (e.g., a computer, printer, etc.) or other device (e.g., an integrated circuit chip), or implemented as a program of instructions (e.g., software) embodied on a device-readable medium.

2. Description of the Related Art

An ink-jet printer renders images by ejecting tiny droplets of ink through nozzles carried on an ink-jet head onto an output medium. The print head and medium move relative to each other to sweep a two-dimensional area on which the image or other representation is rendered. Typically, the head contains multiple nozzles to minimize the amount of mechanical motion required to cover a two-dimensional area, while providing the desired printing resolution. Printing resolution is specified by a combination of spatial and color resolutions. Spatial resolution refers to the number of distinctly addressable drop locations on an output medium (e.g., a piece of paper). Color resolution refers to the ability of the printer to deposit multiple drops or multiply-sized drops at a given location on the medium.

An ink-jet head is characterized by a number of parameters, such as the number of nozzles, nozzle geometry, nozzle spacing, etc. Each nozzle can fire droplets at a certain rate determined by its construction, the actuation mechanism, the materials composing the head, and ink properties such as viscosity and surface tension.

The process of halftoning converts a continuous tone image to a representation that indicates the amount of ink to be deposited at each addressable location on the output medium. This information then needs to be translated to the actual firing of print head nozzles over space and time to render the desired image. The translation of the halftone processing result to nozzle-firing sequences is subject to constraints imposed by the desired spatial and color resolutions, print head parameters, ink and output medium. For example, the output resolution is typically higher than the spacing between nozzles (see FIG. 1), thus requiring multiple passes. The output medium may be composed of a variety of materials, such as, paper, cloth, plastic, etc., and the rate of ink absorption and the interaction between droplets on the medium is strongly dependent on the material properties of the ink and output medium. Further, due to mechanical misalignment and noise in the print head or medium transport mechanisms, printing all droplets along a given image row, in a single pass, may lead to undesirable visual artifacts. In other cases, if the nozzle firing rate for a given ink is too low to print at the required resolution for a given head speed, multiple passes of the head relative to the output medium, may be required.

While nozzle firing algorithms currently exist, the current technology does not provide a unified approach to automatically designing such algorithms to incorporate a variety of specifiable constraints in the form of design rules to achieve an appropriate firing algorithm for a particular printer/output medium.

OBJECTS OF THE INVENTION

Accordingly, it is an object of the present invention to overcome the above-mentioned problems with the current technology.

It is another object of this invention to provide algorithms that provide a unified approach for automatically generating a nozzle scheduling/firing algorithm that is appropriate for a given printer and/or output medium, considering a variety of constraints, such as the properties of the ink-jet head, ink and media.

SUMMARY OF THE INVENTION

According to one aspect, this invention provides a method for designing a nozzle firing sequence for a print head carrying a plurality of nozzles adapted to be selectively fired to deposit ink droplets on an output medium. The method comprises the steps of designing an array of $S_r \times S_c$ distinct rank elements, one for each firing location on the output medium, the value of each element representing the rank of the corresponding location; and designing at least one matrix $P_{ijn}$, where (i, j) represents the location and n represents the pass of the print head over the output medium. Each value of $P_{ijn}$ indicates whether or not a nozzle is to be fired at that particular location during that particular print head pass as specified by i, j, n, and $P_{ijn}$ satisfies the constraint $$\sum_n P_{ijn} = K,$$

where K is an integer greater than or equal to 1 representing the maximum number of droplets that can be deposited at a particular location. In accordance with this aspect of the invention, the values of $P_{ijn}$ are determined based on n, $S_c$, $S_r$ and N, where N represents the total number of passes of the print head, and on parameters and properties of the print head and on the properties of the ink and the output medium.

Preferably, the parameters of the print head comprise number of nozzles, nozzle geometry, and/or nozzle spacing, and the properties of the print head comprise its actuation mechanism, and/or the materials of which it is constructed.

Preferably, the properties of the ink comprise one or more of the following: its viscosity and surface tension, and the properties of the output medium comprise its composition.

In another aspect, a nozzle firing sequence for a nozzle-equipped print head comprises the steps of designing an array of $S_r \times S_c$ distinct rank elements, one for each firing location on the output medium, the value of each element representing the rank of the corresponding location; and designing at least one matrix $P_{ijn}$, where (i, j) represents the location and n represents the pass of the print head over the output medium. Each value of $P_{ijn}$ indicates whether or not a nozzle is to be fired at that particular location during that particular print head pass as specified by i, j, n, and $P_{ijn}$ satisfies the constraint $$\sum_n P_{ijn} = K,$$

where K is an integer greater than or equal to 1 representing the maximum number of droplets that can be deposited at a particular location. In accordance with this aspect of the invention, values of $P_{ijn}$ are determined based on a set of feasible locations maintained in a corresponding, periodically updated, binary-valued array $F_{ijn}$ that is based on constraints resulting from parameters and properties of the print head and on the properties of the ink and the output medium.

Preferably, each constraint on which $F_{ijn}$ is based is mapped into a corresponding one of the feasible sets.

Preferably, each value of $P_{ijn}$ that is assigned a non-zero value modifies the set of feasible locations maintained in $F_{ijn}$, and $F_{ijn}$ is updated with each non-zero assignment of $P_{ijn}$.

In another aspect, the invention involves an apparatus, which may be a computer or a printer, for designing a nozzle firing sequence for a print head carrying a plurality of nozzles adapted to be selectively fired to deposit ink droplets on an output medium. The apparatus comprises modules configured to perform various processing described above in connection with the methods. Each module may be conveniently implemented in software, or alternatively with hardware. In the latter case, the hardware may include one or more of the following: an instruction-based processor (e.g., a central processing unit (CPU)), an Application Specific Integrated Circuit (ASIC), digital signal processing circuitry, or combination thereof.

In accordance with further aspects of the invention, either of the above-described methods or any of the steps thereof may be embodied in a program of instructions (e.g., software) which may be stored on, or conveyed to, a computer or other processor-controlled device for execution. Alternatively, the method or any of the steps thereof may be implemented using functionally equivalent hardware (e.g., ASIC, digital signal processing circuitry, etc.) or a combination of software and hardware.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A. Introduction

Figure 1:
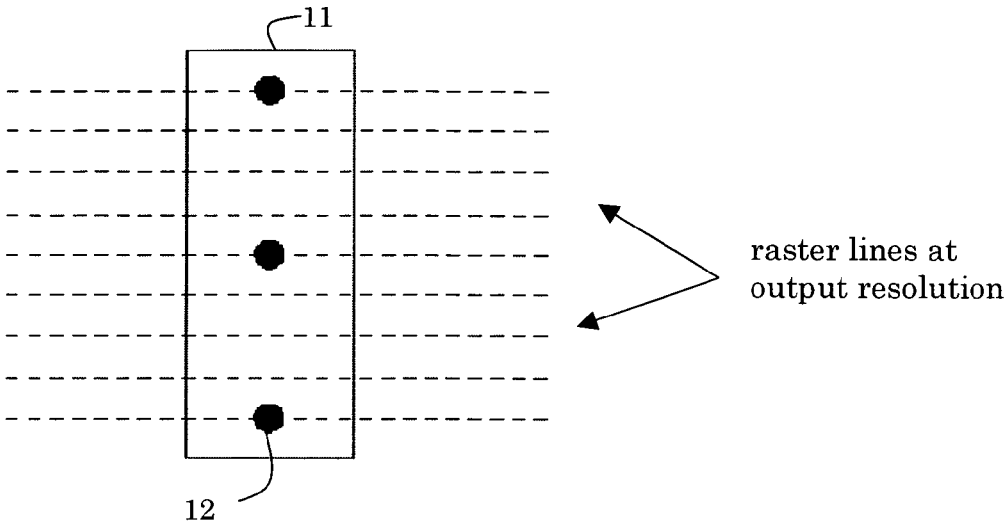
FIG. 1 is a schematic diagram of a print head with nozzles illustrating the spacing of the nozzles relative to the raster lines at output resolution.

The present invention provides nozzle firing algorithms as well as a framework and a unified approach to designing such algorithms that incorporate a variety of specifiable nozzle-firing constraints stemming from nozzle geometry, maximum nozzle-firing frequency, head movement (number of passes), ink and output media properties and the interaction therebetween, interaction across color channels, registration or noise in the output medium, print head or transport mechanisms, etc. Such constraints are provided as design rules for a given printer/output medium, and the result is an appropriate nozzle firing algorithm. The method may be used to generate nozzle firing sequences in a halftone-dependent or halftone-independent manner. The halftone independent scheme requires low memory for implementation, while the halftone dependent scheme may be used where ample processing and memory is available, and where there is a need to minimize the number of print head passes over the output medium.

B. Problem to be Solved

Consider the array of all pixel locations on the output medium that need to be addressed to achieve the desired printing resolution. Each pass of the print head relative to the output medium is typically able to address only a subset of these locations. Multiple passes are required to address all pixel locations. The problem domain can be represented as a three-dimensional lattice, where two dimensions are used to represent output pixel locations, and the third is used to index each pass of the print head. Denote this lattice as $P_{ijn}$, where (i, j) indexes the pixel location, and n indexes the print head pass over the output medium. If the print head includes nozzles for different inks, each ink is associated with such a lattice. For a given ink, the problem of nozzle scheduling can be stated as the problem of assigning two states (denoted 0 for no droplet, and 1 for firing a droplet) to each element of $P_{ijn}$, such that $$\sum_n P_{ijn} = 1$$

for all (i, j). Some printing engines support the depositions of multiple droplets of the same size at a given pixel location. For such printers the condition to be satisfied is $$\sum_n P_{ijn} = K$$

for all (i, j), where K is the maximum number of droplets that may be deposited at a given pixel. For nozzles that are able to deliver a variable quantity of ink, the problem is one of assigning a continuous number between 0 and 1 (denoting the amount of ink deposited as a fraction of the maximum ink that may be deposited) to each element of $P_{ijn}$, such that $$\sum_n P_{ijn} = 1.$$

For a given ink in a given pass n, only a subset of locations $P_{ijn}$, may be assigned a non-zero value. This set is determined by the nozzle geometry (or layout) of all nozzles on the print head that deliver the given ink. Further, if the maximum nozzle-firing frequency of the head is not high enough, droplets cannot be deposited at all locations. Thus, with reference to FIG. 1, which shows a print head 11 with nozzles 12 spaced four times as wide as the output printing resolution, such a print head 11 can simultaneously deposit droplets only every fourth row (times the number of nozzles), and depending on the maximum nozzle-firing frequency it may not be able to deposit droplets at all locations in the feasible rows. In addition, other constraints as outlined above may further restrict the feasible set. Thus, if the ink and output medium properties do not allow adjacent cells to be inked in the same pass (e.g., because such inking could cause unacceptable droplet interaction between adjacent pixels), the feasible set would be further restricted to exclude the printing of adjacent pixels.

It should be noted that the three nozzle print head shown in FIG. 1 is simply intended to illustrate an exemplary relationship between nozzle spacing and output printing resolution. It will be understood by those skilled in the art that a print head may have more than three nozzles and that some print heads have a different nozzle spacing relative to output printing resolution.

C. Constraint Specification

Constraints are specified as intersections of feasible sets. Each location of $P_{ijn}$ that is assigned a non-zero value modifies the set of feasible locations for the next non-zero assignment. The set of feasible locations are maintained in a corresponding binary-valued array, $F_{ijn}$, that is updated with each non-zero assignment of $P_{ijn}$.

A set of constraints (e.g., each of the constraints described in the above section) is mapped into corresponding constraints on feasible sets. Thus, in one embodiment, the nozzle geometry constraint translates to: if the location $P_{rcp}$ is assigned a non-zero value, mark as infeasible all rows in $F_{ijp}$ that are inconsistent with a nozzle at row r given the nozzle geometry. The updated feasible set $F_{ijn}$ forms the set of allowable locations for the next non-zero assignment of $P_{ijn}$. Note that the indices of $P_{rcp}$ represent row, column and pass respectively. The index p in $F_{ijp}$ represents the pass.

D. Designing a Nozzle Firing Sequence

Methods for designing nozzle-firing sequences that meet specified conditions will now be described.

D.1 The Minimal Constraints Case

Consider the simple case where the nozzle spacing is equal to the desired print resolution, and the nozzle firing rate allows droplet deposition at all pixel locations along the scan direction in a single print head pass. Further, assume that there are no constraints due to material properties of ink and output medium that restrict the feasible set any more than marking only the previous and currently assigned elements of $P_{ijn}$ as infeasible.

In this scenario, multiple passes would be desirable to minimize the perception of mechanical registration problems by assigning droplet deposition at different locations to different print head passes. If single pass printing is employed, then artifacts such as white bands between two successive passes of the print head may appear due to mechanical misalignment.

To design a nozzle-firing sequence in this situation start with a stochastic screen. A stochastic screen is a two-dimensional array of $S_r \times S_c$ elements, where each element is an integer in the range 0, . . . , $S_rS_c-1$, and no element is repeated. The value of each element of this array is called the rank of the location. Ranks are typically assigned so that the location with a given rank is furthest away from all locations with lesser ranks. In one embodiment, the distance between locations is measured as the shortest between the points obtained by mapping the array to a torus, as described in commonly owned application Ser. No. 10/435,445, filed on May 9, 2003 and entitled "Rapid Design of Smooth Multi-Level Multi-Frequency Screens," the contents of which are incorporated by reference herein.

Denote the elements of the stochastic screen by $S_{ij}$, where i=0, . . . , $S_r-1$, and j=0, . . . , $S_c-1$. For an N-pass design, the elements $P_{ijn}$ are assigned as follows:

$$P_{ijn} = \begin{cases} 1: & \frac{nS_rS_c}{N} \le s_{ij} < \frac{(n+1)S_rS_c}{N} \\ 0 & \text{otherwise} \end{cases}; \quad (1)$$

$$n = 0, \ldots, N-1,\ i = 0, \ldots, S_r - 1,\ j = 0, \ldots, S_c - 1.$$

It can be verified that this assignment satisfies the constraint $$\sum_{n=0}^{N-1} P_{ijn} = 1$$

for all locations (i, j). The firing pattern for all rows and columns is generated by periodically replicating the above assignment along rows and columns to cover the entire output representation.

Figure 2:
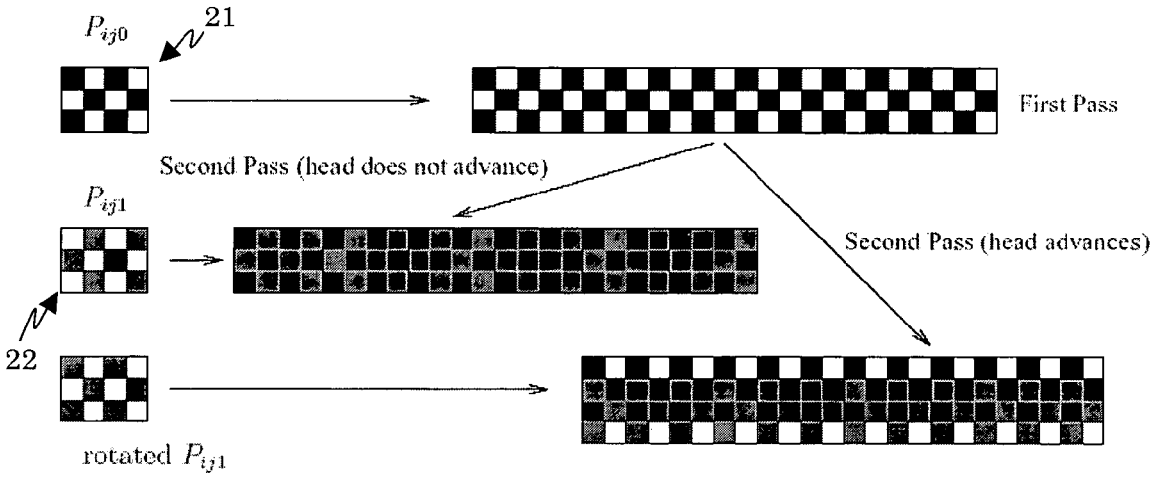
FIG. 2 illustrates two possible nozzle-firing sequences using the same $P_{ijn}$ array for the cases of (1) the head not advancing, and (2) the head advancing between successive rows.

To illustrate, consider the case N=2 (a two-pass assignment). In one embodiment, the print head may print two passes without advancing any rows between passes. In another embodiment, the head may move forward by half (or some other fraction) of the number of nozzles before printing the next pass. If the head moves forward by a certain number of rows before printing the second pass, the $P_{ij1}$ matrix is also rotated by the same number of rows to ensure that the output from $P_{ij0}$ is properly aligned with the output from $P_{ij1}$. These two alternatives are illustrated in FIG. 2. Successive passes alternating between $P_{ij0}$ 21 and $P_{ij1}$ 22 need to be performed by successive row rotations when the print head advances between passes. No rotation is required if the head does not advance between passes.

As seen in FIG. 2, printing with the print head advancing between successive passes leads to faster printing, and the interleaving between printed rows is expected to reduce banding artifacts caused by mechanical misalignment or noise in the print head and output medium transport mechanisms.

The constraint $$\sum_{n} P_{ijn} = K$$

may be realized simply by NK passes and assigning $P_{ijn}=P_{ij(n \bmod N)}$. If the number of passes desired is less than NK, combinations of $P_{ijn}$ may be added together (or collapsed) to form a single pass to achieve the desired number of passes. If the print head can print only one drop per pass, the collapsing of $P_{ijn}$ must satisfy the constraint that time indices m and n may be collapsed into a single pass only if $$\left\lfloor \frac{m}{N} \right\rfloor = \left\lfloor \frac{n}{N} \right\rfloor.$$

D.2 Adding More Constraints

The addition of constraints that restrict the set of feasible locations that can be assigned a non-zero value in $P_{ijn}$ is handled by a minor modification to the procedure described in the above subsection. Specifically, in the previous subsection, the locations corresponding to the first $$\frac{S_r S_c}{N}$$

ranks were assigned to the first pass, the next set of ranks were assigned to the next pass, and so on. The modified method begins by first marking all locations in $P_{ijn}$ as feasible. Locations are then assigned one at a time starting from the location corresponding to the lowest rank. Each added location (or each assignment of a non-zero value to $P_{ijn}$) leads to a modification of the set of feasible locations for the next addition. The next location assigned is chosen as the lowest ranked location amount the set of feasible locations. Constraints specified across ink channels are handled by sequentially assigning locations for each ink's $P_{ijn}$ cyclically, and propagating the feasible set constraints imposed by each assignment to all color channels before the next assignment.

The modification described above is repeated until all locations have been assigned. As before, the first $$\frac{S_r S_c}{N}$$

of the assigned locations are fired in the first pass, the next in the second, and so on.

While no feasible locations remain, but all locations have not been assigned, the number of passes is increased by one.

The use of stochastic screens with periodic properties allows efficient nozzle sequencing for the methods presented in this and the previous subsection. Only a single period of the matrices $P_{ijn}$ need be stored to sequence nozzles for any output image. A nozzle is fired if $P_{ijn}$ for a given pass (n) and location (i, j) is 1, and the halftone data specifies a droplet to be deposited at the location. For the case $$\sum_n P_{ijn} > 1$$

(multiple droplets), after firing the nozzle at location (i, j), the halftone data for the location is decremented to represent the number (or size) of droplets that remain to be deposited at (i, j).

D.3 Halftone-Dependent Nozzle Sequencing

If sufficient processing and memory are available, the number of passes may be reduced and determined adaptively by only considering locations that need droplets. As a result of halftoning, a large number of locations in $P_{ijn}$ may be ignored (or not assigned a non-zero value), since no drops need to be deposited at those locations. The modified constraint to be satisfied by the elements of $P_{ijn}$ in this case is $$\sum_n P_{ijn} \le H_{ij},$$

where $H_{ij}$ represents the number of droplets of ink to be deposited at location (i, j).

E. Flow Chart

Figure 3:
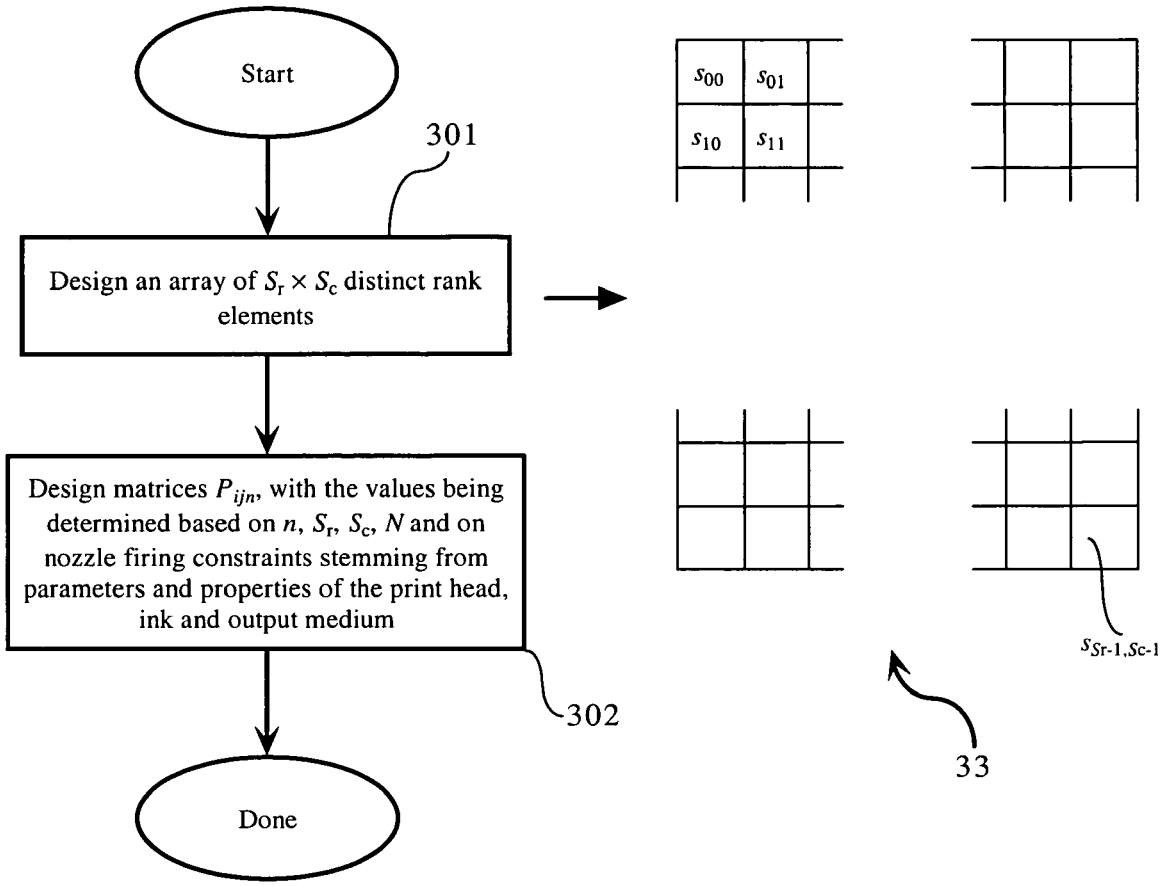
FIG. 3 is a flow diagram illustrating a nozzle-firing design algorithm in accordance with embodiments of the present invention.

Having described the details of the invention, an exemplary method for designing a nozzle firing algorithm will now be described with reference to FIG. 3. The design method involves designing an array 33 of $S_r \times S_c$ distinct rank elements, as described above (step 301). As shown in the schematic diagram of array 33 in FIG. 3, there is one distinct rank element for each firing location on the output medium, and the value of each element represents the rank of the corresponding location. Then, the $P_{ijn}$ matrices are designed, where (i, j) represents the location, and n represents the pass of the print head over the output medium (step 302). As explained in detail above, each value of $P_{ijn}$ indicates whether or not a nozzle is to be fired at that particular location during that particular print head pass as specified by i, j, n. $P_{ijn}$ satisfies the constraint $$\sum_n P_{ijn} = K,$$

where K is an integer greater than or equal to 1 representing the maximum number of droplets that can be deposited at a particular location. In accordance with the invention, the values of $P_{ijn}$ are determined based on n, $S_c$, $S_r$ and N, where N represents the total number of passes of the print head, and on parameters and properties of the print head and on the properties of the ink and the output medium.

F. Implementations and Applications

A nozzle scheduling algorithm, in accordance with the present invention, may be implemented in a variety of different ways. Software, hardware, or software/hardware combinations are possible.

Figure 4:
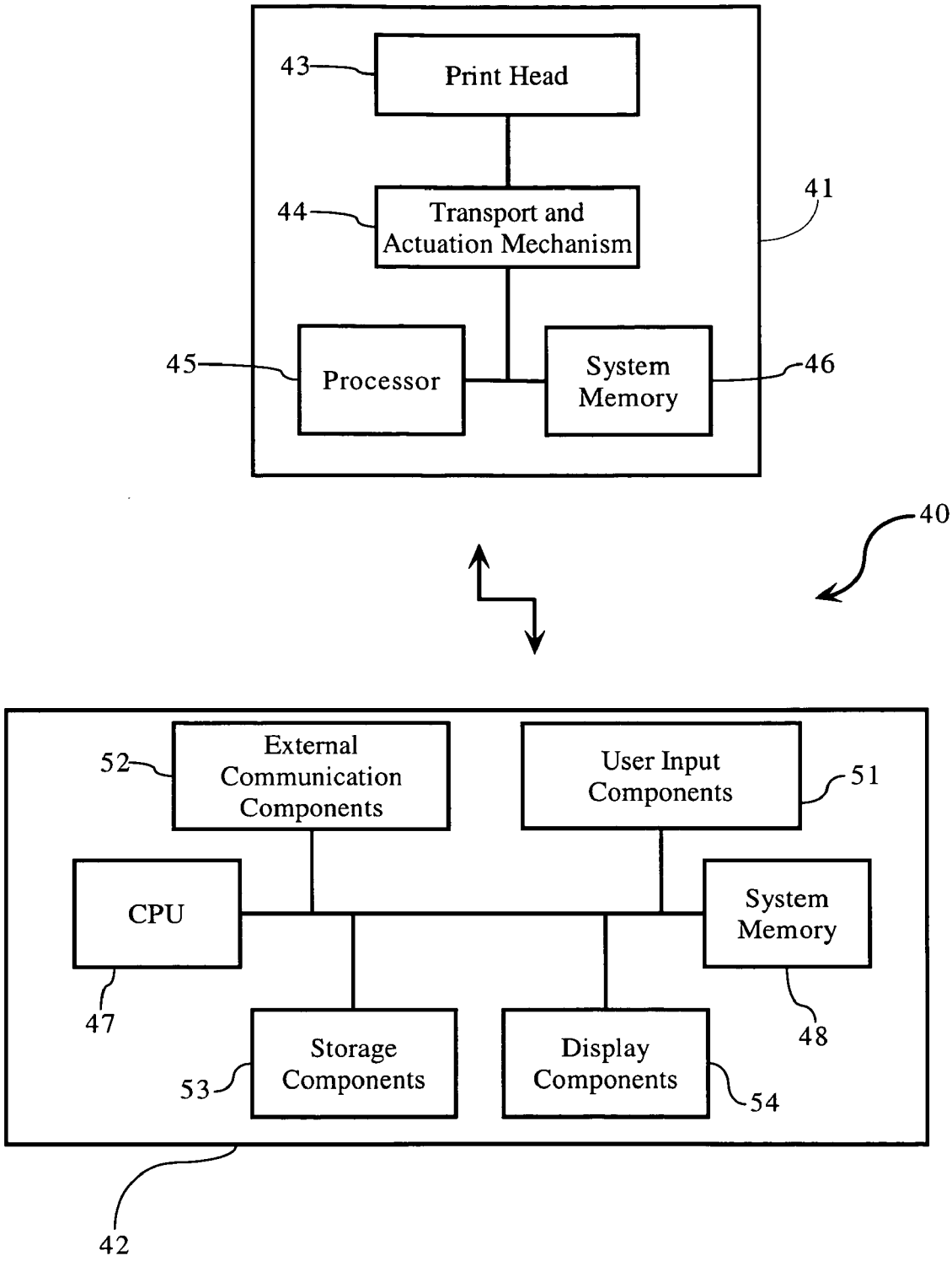
FIG. 4 is a block diagram of an exemplary image processing system which includes a printer in communication with a computer device and which may be used to implement embodiments of the present invention.

To this end, a nozzle scheduling algorithm may be embodied in an image processing system 40 which comprises a printer 41 that is in communication with a computer device 42, as shown in FIG. 4. The algorithm may be embodied in either the printer 41 or computer device 42.

The printer 41 is preferably an ink-jet printer, while the computer device 42 may be implemented in any of a variety of configurations including as a desktop or laptop computer, or as a hand-held device such as a cell-phone or personal digital assistant (PDA) that is suitable for running the algorithm of the present invention. It should be noted that the algorithm may also be embodied in other suitable arrangements.

The ink-jet printer 41 includes a print head 43 on which a plurality of nozzles are carried, and transport and actuation mechanisms 44 that drive the print head and fire the nozzles respectively. The printer 41 may also include a processor 45 for controlling the printer and system memory 46 which may be in the form of random-access memory (RAM) and read-only memory (ROM).

The computer device of FIG. 4 includes a central processing unit (CPU) 47 that provides computing resources and controls the device. CPU 47 may be implemented with a microprocessor or the like that is appropriate for the type of device. Depending on the specific configuration of the system, CPU 47 may share resources and tasks such as image processing with processor 45 in the printer 41 in processing an image to be printed in accordance with this invention. Device 42 further includes system memory 48 which may include RAM and ROM.

Device 42 typically includes a number of components, which may be embodied directly in the device or provided as peripherals depending on the type of device. In the illustrated embodiment of FIG. 4, user input components 51 may include a keyboard, mouse or stylus as is appropriate for the particular device.

There are also external communication components 52 that communicate with external devices to send and receive information (i.e., programs and data) including images to be printed in accordance with this invention. To this end, communication components 52 typically include components to connect to remote devices through any of a variety of networks (wired or wireless) including the Internet, a local or wide area network, or through any suitable electromagnetic carrier signals including infrared signals. Communication components 52 may include a printer controller for communicating with printer 41.

Storage components 53 include a storage device that may be used to record programs of instructions for operating systems, utilities and applications which may include embodiments of programs that implement various aspects of the present invention. Such a storage device may also be used to store image data to be processed in accordance with the invention. Display components 54 include a display that may be of any known type that is suitable for the particular device.

All major components in each of the printer 41 and computer device 42 are connected through a bus which may represent more than one physical bus.

As will be appreciated, the nozzle designing and resulting firing algorithms may be conveniently implemented in either the printer 41 or device 42 with software. Of course, a hardware implementation or combined hardware/software implementation is also possible. A hardware implementation may be realized, for example, using ASIC(s), digital signal processing circuitry, or the like. As such, the claim language "machine-readable medium" includes not only software-carrying media, but also hardware having instructions for performing the required processing hardwired thereon, as well as a combination of hardware and software. Similarly, the claim language "program of instructions" includes both software and instructions embedded on hardware. Also, each of the modules referred to in the claims covers any appropriately configured device that is capable of performing the functions recited. Such devices may include, for example, an instruction-driven processor (e.g., a CPU), ASIC, digital signal processing circuitry, or combination thereof. With these implementation alternatives in mind, it is to be understood that the figures and accompanying description provide the functional information one skilled in the art would require to write program code (i.e., software) or to fabricate circuits (i.e., hardware) to perform the processing required.

As the foregoing description demonstrates, the present invention provides nozzle scheduling algorithms that are able to incorporate a wide variety of nozzle-firing constraints stemming from parameters or characteristics of the print head/nozzles including geometry, firing frequency and head movement, from properties of the ink and the output media, from interaction between the ink and output media, from cross color channel interaction, and/or from registration or noise in any of the output medium, print head or transport mechanisms. Such constraints are provided as design rules for a given printer/output medium, and the result is an appropriate nozzle firing algorithm. The method may be used to generate nozzle firing sequences in a halftone-dependent or halftone-independent manner. When combined with a block-based halftoning algorithm, the design method of this invention is well suited for low-memory applications such as printing from a cell phone or other handheld device.

While the invention has been described in conjunction with several specific embodiments, many further alternatives, modifications, variations and applications will be apparent to those skilled in the art that in light of the foregoing description. Thus, the invention described herein is intended to embrace all such alternatives, modifications, variations and applications as may fall within the spirit and scope of the appended claims.

What is claimed is:

1. A method for designing a nozzle firing sequence for a print head carrying a plurality of nozzles adapted to be selectively fired to deposit ink droplets on an output medium, comprising the steps of:

(a) designing an array of $S_r \times S_c$ distinct rank elements, one for each firing location on the output medium, the value of each element representing the rank of the corresponding location; and (b) designing at least one matrix $P_{ijn}$ wherein (i, j) represents the location and n represents the pass of the print head over the output medium, wherein each value of $P_{ijn}$ indicates whether or not a nozzle is to be fired at that particular location during that particular print head pass as specified by i, j, n, and wherein $P_{ijn}$ satisfies the constraint $$\sum_n P_{ijn} = K,$$

where K is an integer greater than or equal to 1 representing the maximum number of droplets that can be deposited at a particular location, the values of $P_{ijn}$ being determined based on n, $S_c$, $S_r$ and N, where N represents the total number of passes of the print head, and on parameters and properties of the print head and on the properties of the ink and the output medium.

2. A method as recited in claim 1, wherein the parameters of the print head comprise one or more of the following: number of nozzles, nozzle geometry, and nozzle spacing.

3. A method as recited in claim 1, wherein the properties of the print head comprise one or more of the following: its actuation mechanism, and the materials of which it is constructed.

4. A method as recited in claim 1, wherein the properties of the ink comprise one or more of the following: its viscosity and surface tension.

5. A method as recited in claim 4, wherein the properties of the output medium comprise its composition.

6. A method for designing a nozzle firing sequence for a print head carrying a plurality of nozzles adapted to be selectively fired to deposit ink droplets on an output medium, comprising the steps of:

(a) designing an array of $S_r \times S_c$ distinct rank elements, one for each firing location on the output medium, the value of each element representing the rank of the corresponding location; and (b) designing at least one matrix $P_{ijn}$ wherein (i, j) represents the location and n represents the pass of the print head over the output medium, wherein each value of $P_{ijn}$ indicates whether or not a nozzle is to be fired at that particular location during that particular print head pass as specified by i, j, n, and wherein $P_{ijn}$ satisfies the constraint $$\sum_n P_{ijn} = K,$$

where K is an integer greater than or equal to 1 representing the maximum number of droplets that can be deposited at a particular location, the values of $P_{ijn}$ being determined based on a set of feasible locations maintained in a corresponding, periodically updated, binary-valued array $F_{ijn}$ that is based on constraints resulting from parameters and properties of the print head and on the properties of the ink and the output medium.

7. A method as recited in claim 6, wherein each constraint on which $F_{ijn}$ is based is mapped into a corresponding one of the feasible sets.

8. A method as recited in claim 7, wherein each value of $P_{ijn}$ that is assigned a non-zero value modifies the set of feasible locations maintained in $F_{ijn}$.

9. A method as recited in claim 8, wherein $F_{ijn}$ is updated with each non-zero assignment of $P_{ijn}$.

10. An apparatus for designing a nozzle firing sequence for a print head carrying a plurality of nozzles adapted to be selectively fired to deposit ink droplets on an output medium, comprising:

an array-design module configured to design an array of $S_r \times S_c$ distinct rank elements, one for each firing location on the output medium, the value of each element representing the rank of the corresponding location; and a matrix-design module configured to design at least one matrix $P_{ijn}$, wherein (i, j) represents the location and n represents the pass of the print head over the output medium, wherein each value of $P_{ijn}$ indicates whether or not a nozzle is to be fired at that particular location during that particular print head pass as specified by i, j, n, and wherein $P_{ijn}$ satisfies the constraint $$\sum_n P_{ijn} = K,$$

where K is an integer greater than or equal to 1 representing the maximum number of droplets that can be deposited at a particular location.

11. An apparatus as recited in claim 10, wherein, in designing the matrix $P_{ijn}$, the matrix-design module determines the values of $P_{ijn}$ based on n, $S_c$, $S_r$ and N, where N represents the total number of passes of the print head, and on parameters and properties of the print head and on the properties of the ink and the output medium.

12. An apparatus as recited in claim 10, wherein, in designing the matrix $P_{ijn}$, the matrix-design module determines the values of $P_{ijn}$ based on a set of feasible locations maintained in a corresponding, periodically updated, binary-valued array $F_{ijn}$ that is based on constraints resulting from parameters and properties of the print head and on the properties of the ink and the output medium.

13. A machine-readable medium carrying a program of instructions for directing a machine to design a nozzle firing sequence for a print head carrying a plurality of nozzles adapted to be selectively fired to deposit ink droplets on an output medium, the program of instructions comprising:

(a) instructions for designing an array of $S_r \times S_c$ distinct rank elements, one for each firing location on the output medium, the value of each element representing the rank of the corresponding location; and (b) instructions for designing at least one matrix $P_{ijn}$ wherein (i, j) represents the location and n represents the pass of the print head over the output medium, wherein each value of $P_{ijn}$ indicates whether or not a nozzle is to be fired at that particular location during that particular print head pass as specified by i, j, n, and wherein $P_{ijn}$ satisfies the constraint $$\sum_n P_{ijn} = K,$$

where K is an integer greater than or equal to 1 representing the maximum number of droplets that can be deposited at a particular location, the values of $P_{ijn}$ being determined based on n, $S_c$, $S_r$ and N, where N represents the total number of passes of the print head, and on parameters and properties of the print head and on the properties of the ink and the output medium.

14. A machine-readable medium as recited in claim 13, wherein the parameters of the print head comprise one or more of the following: number of nozzles, nozzle geometry, and nozzle spacing.

15. A machine-readable medium as recited in claim 13, wherein the properties of the print head comprise one or more of the following: its actuation mechanism, and the materials of which it is constructed.

16. A machine-readable medium as recited in claim 13, wherein the properties of the ink comprise one or more of the following: its viscosity and surface tension.

17. A machine-readable medium as recited in claim 16, wherein the properties of the output medium comprise its composition.

18. A machine-readable medium carrying a program of instructions for directing a machine to design a nozzle firing sequence for a print head carrying a plurality of nozzles adapted to be selectively fired to deposit ink droplets on an output medium, the program of instructions comprising:

(a) instructions for designing an array of $S_r \times S_c$ distinct rank elements, one for each firing location on the output medium, the value of each element representing the rank of the corresponding location; and (b) instructions for designing at least one matrix $P_{ijn}$ wherein (i, j) represents the location and n represents the pass of the print head over the output medium, wherein each value of $P_{ijn}$ indicates whether or not a nozzle is to be fired at that particular location during that particular print head pass as specified by i, j, n, and wherein $P_{ijn}$ satisfies the constraint $$\sum_n P_{ijn} = K,$$

where K is an integer greater than or equal to 1 representing the maximum number of droplets that can be deposited at a particular location, the values of $P_{ijn}$ being determined based on a set of feasible locations maintained in a corresponding, periodically updated, binary-valued array $F_{ijn}$ that is based on constraints resulting from parameters and properties of the print head and on the properties of the ink and the output medium.

19. A machine-readable medium as recited in claim 18, wherein each constraint on which $F_{ijn}$ is based is mapped into a corresponding one of the feasible sets.

20. A machine-readable medium as recited in claim 19, wherein each value of $P_{ijn}$ that is assigned a non-zero value modifies the set of feasible locations maintained in $F_{ijn}$.

21. A machine-readable medium as recited in claim 20, wherein $F_{ijn}$ is updated with each non-zero assignment of $P_{ijn}$.

* * * * *